United States Patent [19]

Watanabe

[11] Patent Number: 4,909,388

[45] Date of Patent: Mar. 20, 1990

[54] COMPRESSED ROLL PAPER, METHOD OF AND APPARATUS FOR PRODUCING SAME

[76] Inventor: Kouzou Watanabe, 18-25, Fukumitsu Minami-machi, Gifu-shi, Japan

[21] Appl. No.: 336,599

[22] Filed: Apr. 7, 1989

Related U.S. Application Data

[63] Continuation of Ser. No. 124,336, Nov. 19, 1987, abandoned, which is a continuation of Ser. No. 13,167, Feb. 11, 1987, abandoned, which is a continuation of Ser. No. 900,233, Aug. 25, 1986, abandoned, which is a continuation of Ser. No. 611,701, May 18, 1984, abandoned.

[30] Foreign Application Priority Data

Aug. 30, 1983 [JP] Japan ..... 58-91231
Aug. 30, 1983 [JP] Japan ..... 58-158721

[51] Int. Cl.[4] ..... B65D 85/671
[52] U.S. Cl. ..... 206/410; 206/390
[58] Field of Search ..... 206/389, 390, 409, 410, 206/417, 497, 83.5, 442, 391; 53/430

[56] References Cited

U.S. PATENT DOCUMENTS

| | | | |
|---|---|---|---|
| 396,675 | 1/1889 | Wheeler | 206/389 |
| 401,233 | 4/1889 | Wheeler | 206/806 |
| 714,652 | 11/1902 | Davis | 206/390 |
| 733,282 | 7/1903 | Scott | 206/389 |
| 1,170,590 | 2/1916 | Wheeler | 206/389 |
| 1,608,331 | 11/1926 | McElwain | 206/389 |
| 1,929,599 | 10/1933 | Millholland | 206/410 |
| 2,033,582 | 3/1936 | Materno | 221/45 |
| 2,769,533 | 11/1956 | Booth | 206/410 |
| 3,441,129 | 4/1969 | Johansen et al. | 206/497 |
| 3,537,226 | 11/1970 | LeVan et al. | 53/430 |
| 3,587,201 | 6/1971 | Strayer | 206/83.5 |
| 3,641,732 | 2/1972 | Fujio | 206/497 |
| 4,444,311 | 4/1984 | Rias | 206/417 |

FOREIGN PATENT DOCUMENTS

| | | | |
|---|---|---|---|
| 10352 | 9/1885 | United Kingdom | 206/390 |
| 691409 | 5/1953 | United Kingdom | 206/494 |
| 1455825 | 11/1976 | United Kingdom | 206/497 |

*Primary Examiner*—Jimmy G. Foster

[57] ABSTRACT

This disclosure depicts a novel compressed roll paper, wrapped with a plastic film or films, having a flat shape in cross section, that is advantageous in reducing the cost of transportation and being easily restored to a circular shape in cross section for use. Particularly, the roll, being wrapped with a plastic film or films so as to be air-tight or non-permeable to liquid, can avoid deterioration in quality due to rain, moisture and the like during transportation and storage.

1 Claim, 2 Drawing Sheets

COMPRESSED ROLL PAPER, METHOD OF AND APPARATUS FOR PRODUCING SAME

This is a continuation of application Ser. No. 124,336, filed 11/19/87, abandoned, which is a continuation of application Ser. No. 013,167, filed 2/11/87, abandoned, which is a continuation of application Ser. No. 900,233, filed 8/25/86, abandoned, which is a continuation of application Ser. No. 611,701, filed 5/18/84, abandoned.

FIELD OF THE INVENTION

This invention relates to compressed roll of toilet paper and paper towel, i.e. compressed roll paper, and more particularly to a method of and an apparatus for producing a roll of compressed roll paper reduced in volume and rendered compact in size.

BACKGROUND OF THE INVENTION

A cylindrical roll of roll paper is formed into a cylindrical shape in its side surface by winding toilet paper or towel paper on a hollow cylindrical core, so that the roll of roll paper can be continuously and smoothly taken out of a holder in use.

However, the cylindrical shape and the hollow cylindrical core lead to increased voids in the loading, storage and the like rolls of roll paper, thusresulting in bulkiness. Due to these voids caused by the shape of rolls, with the rolls of the conventional roll paper, freight charges, warehouse charges and the like are rather high, which charges are not neglibible in view of of a unit cost of a roll of roll paper. Moreover, in the case of export to the overseas and the like, the freight charges and warehouse charges are increased to a huge amount, and the reduction of these charges has been a great concern in the industry.

To obviate the drawback caused by the cylindrical shape of roll paper as described above, there have been proposed measures for deforming a roll of roll paper into a flat shape to decrease costs required for packing, transporting and storing of rolls of roll paper.

However, none of these measures has been put into practice.

The reason is that, as for roll paper, if it is deformed into crooked shape during transportation for example, its value as an article of trade is deemed to be lowered. When a roll of roll paper is compression deformed into a flat shape, the roll of roll paper is bulged out in one direction and crapes formed thereon are flattened, and folding wrinkles are left to lower elasticity of the roll of roll paper. Although the flattened roll of roll paper is restored to be a round shape for use, the crooked shape of the roll of roll paper cannot be easily obviated and is left as it is. Also when a roll of roll paper is pressed and compression deformed into a flat shape, the roll of roll paper tends to inflate again due to its inherent elasticity when the pressing force is removed. Thus, it is not easy to maintain the shape of the roll of roll paper at the time of being compression deformed due to the pressing, and consequently, the effect of reducing the volume due to the compression deformation is not so much as expected.

SUMMARY OF THE INVENTION

The invention of the present application has been developed to obviate the above-described disadvantages and can be said to be highly valuable technically.

More specifically, the invention of the present application contemplates a roll of compressed roll paper, which is at least liquid-nonpermeably wrapped and of a flat shape in its side surface, i.e. in side contour, and comprising a hollow core having elasticity or flexibility and a roll of roll paper wound around the core, a method of and an apparatus for producing the above-described roll of compressed roll paper.

Now, the inventor of the present invention has found that, for example, even if a roll of the conventional roll paper is pressure formed into a flat shape, the toilet paper and paper towel, being originally given flexibility by furrowing or embossing, are easily restored to the cylindrical shapes only by pushing back the flexed portions at opposite ends thereof as far as the aforesaid flexibility is not damaged, and hence, the application of the toilet paper and paper towel to roll paper holders causes no troubles.

The present inventor has reached the invention of the present application based on the characteristics of restoration due to the flexible properties of the roll paper as described above.

In the description of the specification of the present application, the term of "a flat shape" means a shape whose cross section is flatter than a circle in its side surface, including not only an elliptical shape but also a rectangular shape.

As for the shape of side surface of the roll of compressed roll paper according to the present invention in particular, various shapes between the elliptical shape and the rectangular shape may be adopted, however, it is preferble from the viewpoint of use and forming to adopt a substantially rectangular shape having rounded corners, because of no folding wrinkles being present at the corners. Particularly, it is preferable that a roll of compressed roll paper having the winding length of 65 m has a width of 12 cm and a thickness of 4 m in its cross section at the time of restoration.

According to the present invention, a roll of compressed roll paper is formed under pressure, and, it is preferable to apply pressure to the roll of roll paper simultaneously with film sealing. In consequence, pressure may be applied in the vertical direction for example. However, the application of pressure not only in the vertical direction but also the lateral direction makes it possible to form the roll of roll paper having a suitable shape in its side surface without losing the flexibility thereof.

The roll of compressed rollpaper according to the present invention need not necessarily be one roll of compressed roll paper, but, may be one including the length of a plurality of rolls of compressed roll paper with single perforated lines or the like provided at borders to be cut. Furthermore, as for the core, the core need not necessarily have elasticity. However, the provision of a hollow core with elasticity, which is even slight, makes it possible to easily return from the flat shape to the cylindrical shape.

As a material of the hollow core described above, it suffices to use one which can be easily restored from the flat shape, particularly a thin flat shape, to the circle, i.e. the cylindrical shape. The material of the hollow core may be formed of a rubber or plastic rubber, which is easily returned to the cylindrical shape by unpacking, for example, and further, may be one which is easily deformably flexible, i.e. a material having slight elasticity, such as a tubular paper core. When a roll of the conventional roll paper using the tubular paper core is pressure formed into a flat shape for example, wrinkles are formed at flexed side portions of the tubular paper core. However, when a slight force is applied to the flexed side portions to expand the center portions for use, the tubular paper core can be readily formed into a cylindrical shape, i.e. a roll shape.

In consequence, the flatly formed roll of compressed roll paper according to the present invention can be produced by flatly forming the conventional, ordinary roll paper under pressure. However, the roll paper formed into a flat shape in its side surface, i.e. an elliptical shape or a rectangular shape has a restoring force after the formation to some extent as described above, it is necessary to wrap the roll paper with a plastic film or the like simultaneously with the formation in order to maintain the shape of the roll paper at the time of formation.

To wrap the roll of compressed roll paper thus flatly formed, any of wrap materials including a paper container, a plastics container, a can and the like may be used in addition to plastics film wrapping. Particularly, the plastics film wrapping is easily mechanized, whereby the film seal, particularly individual film seal is easily performed, and moreover, air-tight sealing is practicable, so that the articles can be prevented from deteriorating in quality due to rain, moisture and the like during transportation and storage, thereby proving very sanitary. Further, in the case where both the flat formation under pressure and the film wrapping are simultaneously performed, if the sealing under pressure is effected in vacuo, then the compression can be achieved to a volume half that of the conventional roll-shaped roll paper, and moreover, the restoring force is preferably large as compared with the small volume thereof.

DESCRIPTION OF THE PREFERRED EMBODIMENT

Detailed description will hereunder be given of the present invention with reference to the accompanying drawings, however, the present invention need not necessarily be limited to this description.

Figure 1:
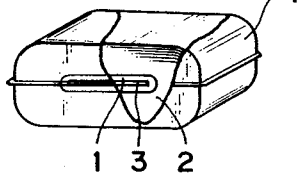
FIG. 1 is a side view of one embodiment of the roll of compressed roll paper according to the present invention.

Referring to FIG. 1 designated at 1 is a core, 3 a hollow portion of the core, and 4 a plastics film wrapping applied to the outer periphery of the compressed roll paper which has a pair of opposed major surfaces compressed to have a substantially flat face and a pair of opposed minor surfaces between the opposed major surfaces. In this drawing, the hollow portion 3 of the core is fairly exaggeratedly drawn, whereby an inner space is shown as being fairly large. However, in the case of a tubular paper core opposing inner wall surfaces of the hollow portion of the core are almost in contact with each other, whereby the inner space is very small even if it exits. However, depending upon the material forming the core and conditions of formation-seal process, the hollow portions of the roll of flatly compressed roll paper according to the invention of the present application may vary widely from a state where the inner space being left is as shown in the drawing to a state where the inner wall surfaces of the core are almost in contact with each other.

Figure 2:
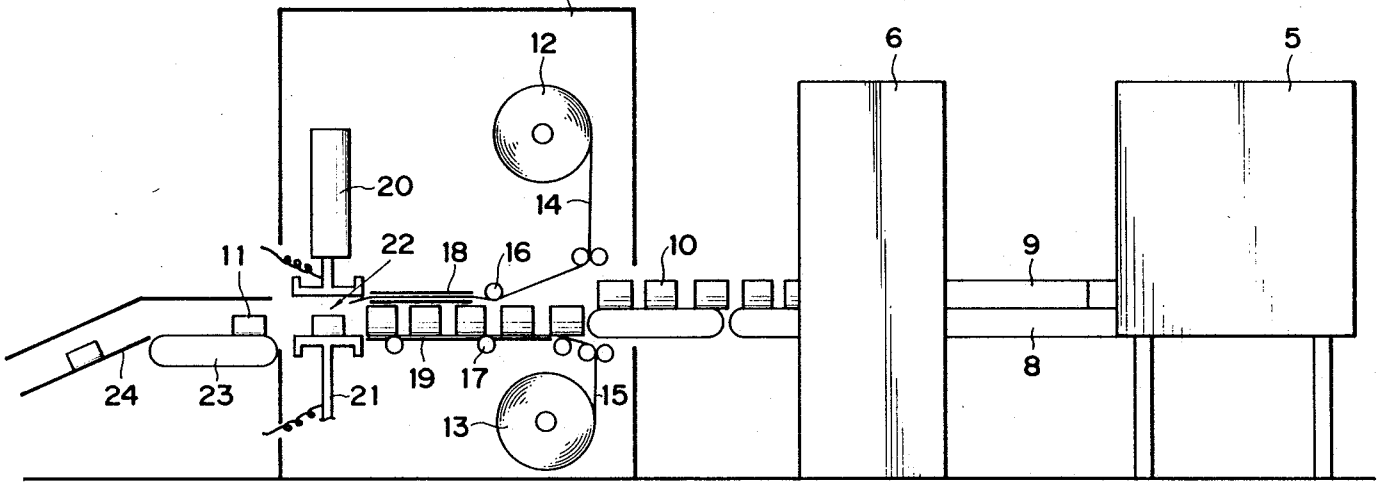
FIG. 2 is a flow sheet showing one embodiment of the method of and the apparatus for producing the roll of compressed roll paper according to the present invention.

In FIG. 2, a cylindrical roll paper receiving processor 5 is connected to a cutting processor 6 and the cutting procesor 6 is connected to a pressure formation-film seal processor 7, through conveyor 8, respectively. In the pressure formation-film seal processor 7, rolls 12 and 13 for films, particularly plastics films are provided above and below a path of a roll paper 10. Also, above and below the path, there are provided film delivery rollers 16 and 17 for feeding films drawn out of the film rolls 12 and 13 to the cut roll paper 10 from above and from below. Above the path of the roll paper 10, a guide plate or plates 18 for guiding a film 14 drawn out by the upper film delivery roller 16 are provided, while, below the path, a guide plate 19 for guiding a film 15 drawn out by the lower film delivery roller 17 is provided. End portions of the guide plates 18 and 19 are connected to a pressure formation-film seal portion 22. Pressure formation presses 20 and 21 are provided upwardly and downwardly of the pressure formation-film seal portion 22, respectively. These pressure formation presses 20 and 21 are provided thereon with film sealing tools capable of carrying out film seal and with limit frames for not impairing the flexibility, both of which are not shown. The film sealing tools of the upper and lower pressure formation presses 20 and 21 are electrically connectibly formed so as to effect the electrical heating for example. In the pressure formation-film seal portion 22, there is provided a delivery tool, not shown, for transferring a roll paper 11 formed and sealed to a delivery conveyor 23 for example. A chute 24 is contiguous to the end portion of the delivery conveyor 23.

A roll 9 of cylindrical roll paper produced in the compressed roll paper production line as shown in this drawing is conveyed by a conveyor belt 8 from the roll receiving processor 5 to a cutting processor 6 having a cutter, e.g. an automatic circular cutter. In the cutting processor 6 having the cutter, the roll 9 may be cut to a suitable length and provided thereon with perforated lines to be cut. In FIG. 2, there are shown only rolls 10 of cylindrical roll paper, i.e. roll-shaped roll paper each provided thereon with perforated lines that may be suitably cut to a length of use.

According to the conventional method, the cylindrical roll paper cut in the cutting process has been film wrapped as is and packed in a box or the like and shipped. However, according to the invention of the present application, subsequently, the cylindrical roll paper thus cut is sent to the pressure formation-film seal processor 7, where it is formed into a flat shape and film sealed.

The roll-shaped roll paper 10 cut in the cutting processor 6 is conveyed by the conveyor belt 8 to the formation-seal processor 7. On the other hand, in the formation-seal processor 7, the wrapping plastics films 14 and 15 are delivered from the film rollers 12 and 13, passed through the guide rolls 16, 17 and the guide plates 18, 19 and conveyed to the formation-seal portion 22. The cut roll-shaped roll paper 10 together with the lower film 15 are conveyed to the formation-seal portion 22. Furthermore, the upper film is sent through the upper guide plate or plates, and suspended on the cut roll-shaped roll paper 10 in a manner to cover the upper portion thereof in the formation-seal portion 22 or in front of the formation-seal portion 22.

In the formation-seal portion 22, there are provided the pressure formation presses 20 and 21 each having means for sealing film. The limit frames, not shown, are opposed to each other in a direction traversing a path of formation-seal portion 22, whereby the cut cylindrical roll paper 10 is conveyed to a space formed between the opposing limit frames, pressed, in such conditions where it is covered by the upper and lower films, by the presses 20 and 21 from above and from below, and sealed with films simultaneously with the formation.

The limit frames may be fixedly provided. However, it is preferable to provide the limit frames in such a manner that the interval of opposition is suitably adjustable. The provision of the limit frames at a suitable interval makes it possible to adjust the pressing in the lateral direction and form the rolls into various types of flatness.

The roll of compressed roll paper thus sealed simultaneously with the formation is moved from the formation-seal portion 22, transferred from a belt conveyor 23 to a chute 24, then packed in corrugated case or the like, and then shipped.

FIG. 2 shows a case of an example where a cut roll of roll paper is sealed with film simultaneously with the pressure formation thereof. However, a plurality of rolls may be wrappingly sealed with film into a single pack simultaneously with the pressure formation, and a long roll of roll paper may be sealed in the same manner as above. Needless to say, the formation process and the seal process may be effected separately of each other. In this case, one roll or a plurality of rolls of flatly compressed roll paper, which have undergone the pressure formation only, are covered with film and sealed.

The provision of a hollow core with elasticity, which is even slight, makes it possible to easily return from the flat shape to the cylindrical shape. As a material of the hollow core 1 described above, it suffices to use one which can be easily restored from the flat shape, particularly a thin flat shape to the circle, i.e. the cylindrical shape. The material of the hollow core 1 may be formed of a rubber or plastics rubber, which are easily returned to the cylindrical shape by unpacking for example, and further, may be formed of one which is easily deformably flexible, i.e. a material having slight elasticity, such as at tubular paper core. When the conventional roll paper using the tubular paper core is pressure formed into a flat shape for example, wrinkles are formed at flexed side portions of the tubular paper core. However, when a slight force is applied to the flexed side portions to expand the center portions for use, the tubular paper core can be readily formed into a cylindrical shape, i.e. a roll shape.

Figure 3:
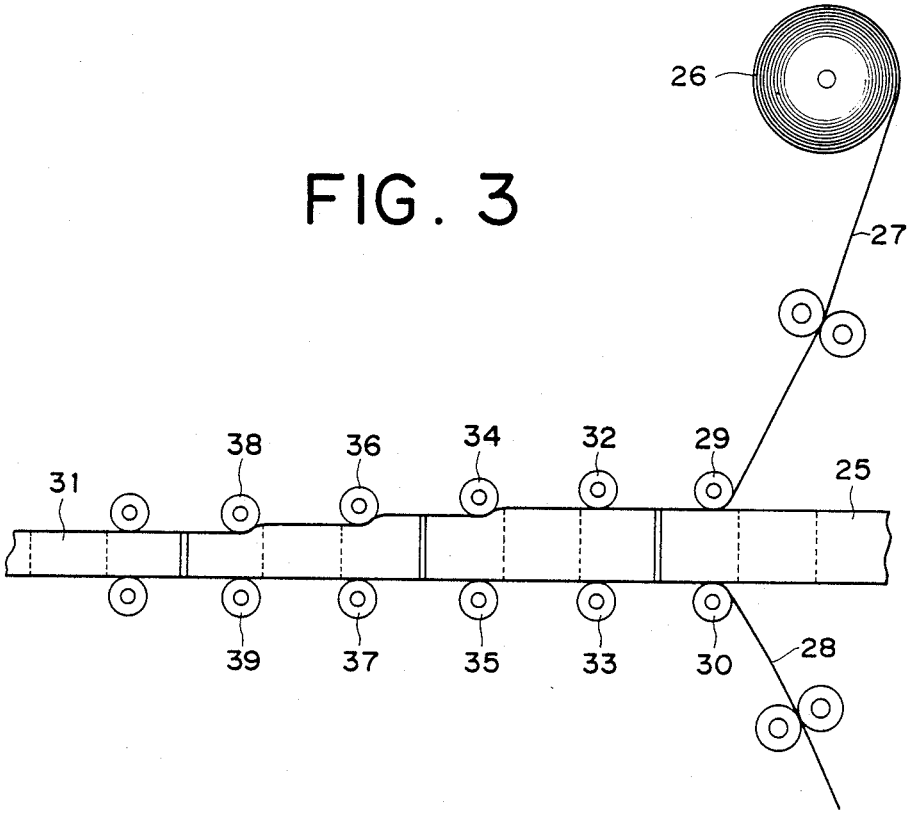
FIG. 3 is a schematic diagram showing the pressure formation process in another embodiment of the method of and the apparatus for producing the roll of compressed roll paper according to the present invention.

FIG. 3 shows an example where a cylindrical roll paper 25 is provided with perforated lines (indicated by broken lines in the drawing), cut to a suitable length, pressed and film sealed. A film roll 26, in which the film is wound into a roll, is provided upwardly of pressure rollers 29, 32, 34, 36 and 38. A film roll, not shown, is also provided downwardly of carrying rollers 30, 33, 35, 37 and 39.

The pressure rollers 29, 32, 34, 36 and 38 are successively downwardly positioned so that the roll paper 25 can be slowly applied thereonto with pressure from above. In consequence, the rollers 32, 33, 34 and 35 are provided such that a space formed between the pressure roller 34 and the carrying roller 35 at the latter stage is made smaller than a space formed between the pressure roller 32 and the carrying roller 33 at the former stage. Similarly, the rollers 34, 35, 36 and 37 are provided such that a space formed between the pressure roller 36 and the carrying roller 37 at the latter stage is made smaller than a space formed between the pressure roller 34 and the lower carrying roller 35 at the former stage. The relationship described above is true of the rollers 38 and 39. As described above, the rollers are provided for suiting to the pressure formation of the roll paper in the intervals therebetween in the row as well as the vertical direction. Particularly, the extent of narrowing of the intervals between the rollers in the vertical direction is suitably adjusted depending upon the quality of paper, the number of windings of paper on a roll and the like. Furthermore, the intervals between the rollers in the same row are designed such that the pressure formation of the roll paper is not crooked in particular.

For example, in FIG. 3, the roll 25 or roll-shaped roll paper, which has been given perforated lines and cut to a suitable length during the cutting process, not shown, is covered at its upper and lower portions with plastics films delivered from a plastics film delivery roller 26 (a lower roller not shown), conveyed by hold-down rollers 29, 32 and the carrying rollers 30, 35, 37 and 39, and formed into a flat shape under pressure of the pressure rollers 34, 36 and 38.

For example, during the forming process shown in FIG. 3, a roll 31 of compressed roll paper, which has been deformed, is sealed by jointing upper and a lower films in front and at the back thereof, and conveyed by carring the rollers after a surplus portion of the sealed film has been cut away.

Figure 4:
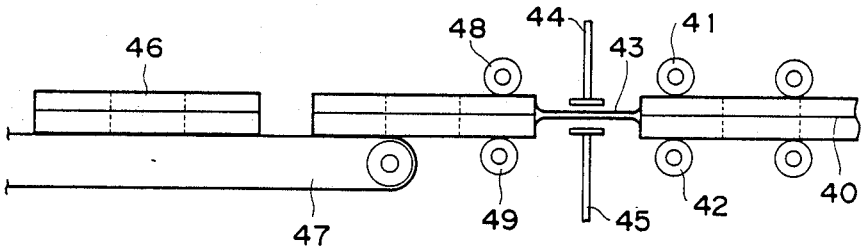
FIG. 4 is a schematic diagram showing the film seal process of in another embodiment of the method of and the apparatus for producing a roll of compressed roll paper according to the present invention.

A flow sheet shown in FIG. 4 may be interpreted that it is connectible to the process shown in FIG. 3. However, this embodiment need not necessarily be limited to the above interpretation in particular.

Carrying rollers 41, 42 and 48, 49 are suitably spaced apart from each other, so that the roll paper film-wrapped, sealed at its front side and given perforated lines may be delivered. Out of these carrying rollers, the carrying rollers designated at 48 and 49 are connected to a driving source, not shown, other than that to which the carrying rollers designated at 41 and 42 are connected.

The carrying rollers 48 and 49 are designed to be rotated faster than the carrying rollers 41 and 42. Heat-sealing devices 44 and 45 are movably provided in the vertical direction traversing the path of the roll paper 46. These heat-sealing devices 44 and 45 are heated by suitable means and clamp a wrapping film or films 43 for the roll paper 46 therebetween to thereby effect fusion seal.

The feed speeds of the conveyor belt 47, the hold-down roller 48 and the carrying roller 49 are made higher tha the feed speeds of the hold-down roller 41 and the roller 42, whereby an interval between the rolls of compressed roll paper adjacent to each other is spaced apart, so that the film or films are stretched. Then, the upper and lower films are clamped between the heat-sealing devices 44 and 45, whereby the upper and lower films are sealed and cut together.

The provision of a suitable vacuum device makes it possible to carry out vacuum sealing.

The compressed roll paper 46 sealed therearound with the film or films is conveyed by the belt conveyor 47 and case-packed.

In pressure forming the roll 25 of roll paper by the pressure forming rollers 34, 36 and 38, limit plates are provided at opposite sides of the roll 25 of roll-shaped roll paper, so that the formed shape can be suitably adjusted.

The roll of compressed roll paper 31 flatly formed is conveyed by carrying rollers to the succeeding process.

In FIG. 3, the roll-shaped paper given perforated lines and having a length of three rolls has been shown. However, not only one roll of roll-shaped roll paper but also a long roll-shaped roll paper may be formed into a flat shape in its side surface.

FIGS. 2 through 4 illustrate the processes in which a roll of roll-shaped roll paper is cut, formed and sealed to produce intended flat rolls of compressed roll paper. However, needless to say, cutting and sealing may be effected after the formation. As the pressure formation device in this case, the one shown in FIG. 3 for example is preferable because the device may be continuously operated.

The compressed roll paper thus sealed according to the present invention is obtained in such a manner that, for example, a cylindrical toilet paper roll having a winding length of 65 m has a diameter of 10.5 cm and a length of 11.7 cm is compressed to have a width of 12 cm, a length of 11.7 cm and a thickness of 4 cm according to the present invention, and that, for example, a cylindrical paper towel having a winding length of 18 m has a diameter of about 12 cm and length of about 24 cm is compressed to have a width of about 16 cm, a length of about 24 cm and a thickness of about 4.5 cm according to the present invention, whereby the volume thereof is decreased to one half that of the cylindrical one, and the configuration is not bulky, so that the load per unit volume can be increased, thus proving outstandingly advantageous in transportation and the like of the toilet paper roll.

If the rolls of the compressed roll paper are contained in a case specially fitted thereto, then the space in the case is more efficiently used, whereby the number of rolls contained in the case is increased by 100%, so that the expenses for transportation can be reduced to one half.

Moreover, the roll of compressed roll paper obtained according to the present invention can maintain the flat shape even when the pressing force is released, so that the volume reduction as described above can be contemplated.

The compressed roll paper as being the product according to the present invention is compressed in a manner not to lose the flexibility. However, the product, maintaining the restoring force of crapes, embosses or the like, can be easily restored to a circular shape by pushing it to inflate at the center portions for use, thus causing no troubles in use.

Moreover, the compressed roll paper wrapped at least liquid-nonpermeably can be prevented from being contaminated or deteriorated by rain and the like during transportation or storage, thereby proving very sanitary. Furthermore, the compressed roll paper wrapped air-tightly can be protected against moisture in addition to the above, thus proving further more sanitary. As has been described hereinabove, the influence brought about by the present invention is significant.

What is claimed is:

1. A compressed roll paper being of a flat shape in cross section, which has a pair of major opposed surfaces compressed to have a substantially flat face and a pair of minor opposed surfaces being between said major surfaces, said compressed roll paper having a core for engaging with a roll holder, said core being wound therearound with emboss and crepe finished paper, said wound-around paper being enveloped therearound with a film and said roll paper being restorable to a generally cylindrical shape when said film is removed and then the opposed minor surfaces are compressed by external forces in a direction opposed to each other, wherein the improvement comprises:

the distance between the opposed major surfaces is smaller than ½ that between said opposed minor surfaces in cross section and is about ½ of the diameter of said roll paper before being compressed;

said compressed roll paper has solidity effective to maintain the flat shape in cross section even when said film is removed unless the opposed minor surfaces are compressed by the external forces in the direction opposed to each other, and said compressed roll paper can be restored due to crepes and embosses which are maintained on said paper to a circular shape only by pushing said roll paper to inflate at the center portions of said roll paper.

* * * * *

UNITED STATES PATENT AND TRADEMARK OFFICE

CERTIFICATE OF CORRECTION

PATENT NO. : 4,909,388

DATED : March 20, 1990

INVENTOR(S) : WATANABE, Kouzou

It is certified that error appears in the above-identified patent and that said Letters Patent is hereby corrected as shown below:

Col. 1, line 25, insert "outer" before --shape--.

Col. 1, line 27, add a space between --thusresulting--.

Col. 1, line 31, change "neglibible" to --negligible--.

Col. 2, line 32, change "preferble" to --preferable--.

Col. 2, line 37, change "4 m" to --4 cm--.

Col. 2, line 49, add a space between --rollpaper--.

Col. 3, line 14, change "plastic" to --plastics--.

UNITED STATES PATENT AND TRADEMARK OFFICE

CERTIFICATE OF CORRECTION

PATENT NO. : 4,909,388

DATED : March 20, 1990

INVENTOR(S) : WATANABE, Kouzou

It is certified that error appears in the above-identified patent and that said Letters Patent is hereby corrected as shown below:

Col. 4, line 15, change "processor" to --processor--.

Col. 6, line 36, insert "an" before --upper--.

Col. 6, line 62, change "tha" to --than--.

Col. 7, line 20, insert "thereafter," after --cut,--.

Signed and Sealed this

Twenty-eighth Day of January, 1992

*Attest:*

*Attesting Officer*

HARRY F. MANBECK, JR.

*Commissioner of Patents and Trademarks*